US005762283A

United States Patent [19]

Buchmeyer et al.

[11] Patent Number: 5,762,283

[45] Date of Patent: Jun. 9, 1998

[54] METHOD FOR PREPARING THE START OF A MATERIAL WEB OF A STOCK ROLL IN A ROLL EXCHANGER, ROLL EXCHANGER AND WEB-TAKEUP DEVICE

[75] Inventors: Theodoor Antonius Buchmeyer, Geldrop; Hubertus Johannes Schoonderbeek, Beuningen, both of Netherlands

[73] Assignee: Stork Contiweb B.V., Boxmeer, Netherlands

[21] Appl. No.: 682,613

[22] PCT Filed: Jan. 27, 1995

[86] PCT No.: PCT/NL95/00040

§ 371 Date: Jul. 25, 1996

§ 102(e) Date: Jul. 25, 1996

[87] PCT Pub. No.: WO95/20537

PCT Pub. Date: Aug. 3, 1995

[30] Foreign Application Priority Data

Jan. 28, 1994 [NL] Netherlands ..... 9400137

[51] Int. Cl.[6] ..... B65H 19/28; B65H 19/14; B65H 21/00

[52] U.S. Cl. ..... 242/532.3; 242/553; 242/556; 242/563

[58] Field of Search ..... 242/553, 532.3, 242/552, 556, 556.1, 526, 563, 534

[56] References Cited

U.S. PATENT DOCUMENTS 4,131,206 12/1978 Kawada et al. ..... 214/1
4,802,632 2/1989 Fukuda et al. ..... 242/58
5,322,230 6/1994 Dylla et al. ..... 242/58

FOREIGN PATENT DOCUMENTS 0 010 901 5/1980 European Pat. Off. .
0 547 500 6/1993 European Pat. Off. .
39 18 552 12/1990 Germany .

*Primary Examiner*—John Q. Nguyen
*Attorney, Agent, or Firm*—Michael D. Bednarek; Kilpatrick Stockton LLP

[57] ABSTRACT

A method and apparatus for preparing the start of a material web of a stock roll (5) in a roll exchanger comprises the steps of bringing a surplus roll (20) removed from a stock-roll holder (3), which surplus roll (20) is incorporated in a frame of web-takeup (11) and to which surplus roll (20) an adhesive is applied, into contact with the material web of the stock roll (5), taking up the material web from the stock roll (5) on the surplus roll (20), winding up a length of the material web from the stock roll (5) on the surplus roll (20), winding up a length of the material web of the stock roll (5) on the surplus roll (20) and severing the material web between the portion of the material web wound on the surplus roll (20) ant the stock roll (5). The roll exchanger is provided with means including, in particular, a web-takeup device (11), in which a surplus roll (20) is or can be mounted so that it can rotate, with which the method can be carried out.

20 Claims, 2 Drawing Sheets

METHOD FOR PREPARING THE START OF A MATERIAL WEB OF A STOCK ROLL IN A ROLL EXCHANGER, ROLL EXCHANGER AND WEB-TAKEUP DEVICE

FIELD OF THE INVENTION

The invention relates to a method for preparing the start of a material web of a stock roll in a roll exchanger, which method comprises the steps of:

a) bringing a cylindrical winding-up body of web-takeup means into contact with the material web of a stock roll, b) taking up the material web from the stock roll on the winding-up body, c) winding up a length of the material web of the stock roll on the winding-up body, and d) breaking the material web between the portion of the material web wound on the winding-up body and the stock roll, creating a new start of the material web of the stock roll.

BACKGROUND

Such a method for automatic preparation in a roll exchanger of the flying type is known from EP-A-547500. Before a new stock roll can be used in a roll exchanger, the stock roll has to be prepared. This preparation comprises unpacking the roll, when the packing material as well as rough, visibly damaged portions of the material web of the stock roll are removed. If desired, an adhesive layer is applied to the new start of the material web. In the known method, preparation takes place in the roll exchanger after the roll has been unpacked, the start of a material web of a new stock roll being fastened to a cylindrical winding-up body by means of, for example, suction onto a vacuum roller, and the damaged portion of the material web is wound up thereon until no further damage is observed. Next, two perforations are made transversely in the material web, an adhesive layer is applied to the top thereof, then the material web is torn off along one of the perforations by a relative movement between that portion of the material web which is wound up on the winding-up body and that portion of the material web which is still wound on the stock roll and the damaged wound-up portion is removed.

Reference is furthermore made in said publication to a possibility, not associated with the invention, whereby the damaged portion is fastened to an interchangeable winding-up sleeve during several preparation cycles, the start, of the material web of a stock roll, to be prepared being securely glued to said sleeve.

A disadvantage of the known method is that, in order to remove the damaged portion of the material web, the latter has to be cut away from the vacuum roller or the interchangeable winding-up sleeve, for which purpose an additional step and cutting device is required. Furthermore, two streams of waste occur in the roll exchanger, namely one of waste material, originating from the winding-up sleeve and one of old unwound stock rolls, the so-called surplus roll. A further disadvantage is that there is a risk of the material web not tearing accurately along the perforation which has been made, it being possible for this to give rise to further damage.

SUMMARY OF THE INVENTION

The object of the invention is to provide a method whereby the abovementioned disadvantages do not arise and which can be carried out in a simple and reliable manner. In particular, the object of the invention is to concentrate and dispose of the waste arising in the roll exchanger as a single stream of waste. A further object of the invention is to restrict the amount of waste removed from the material web.

The method of the abovementioned type according to the invention is characterized in that, prior to step a), a surplus roll of a stock roll is removed from a stock-roll holder and is incorporated in the frame of the web-takeup means as a cylindrical winding-up body for carrying out the subsequent steps a)–d) and an adhesive is applied to at least one of the material webs of the stock roll and/or the surplus roll.

In the method according to the invention, removal of damaged material from the stock roll, from which only the packing material has been removed, takes place in a position in the roll exchanger in which the stock roll can rotate.

The method according to the invention has a number of advantages with respect to the method according to the prior art. One advantage of the method according to the invention is that all the waste material, both the removed portion of a new stock roll as well as the surplus roll, is concentrated at a central point in the roll exchanger, namely on the surplus roll itself, as a result of which it is possible to dispose of it easily. Furthermore, the number of steps is restricted and the means required therefor can be integrated in the structure of the roll exchanger in a simple manner.

Advantageously, a step $c_1$) of fastening the material web to a gripping point between the stock roll and the web-takeup means is carried out after step c) and in step d) the material web is cut off between the gripping point and the web-takeup means. Gripping and cutting-off of the material web can be carried out in a more accurate and more reliable manner compared with the tearing-off according to the prior art, thereby reducing the risk of further damage. This embodiment of the method also makes it possible for a splice to be able to be formed with a roll in the roll exchanger which is unwinding after the prepared stock roll has been transported to an unwinding position in the roll exchanger without associated preparation steps, so that the material web can be supplied smoothly to a subsequent step in the operation, for example printing of the material web.

Preferably, the step $c_1$) is carried out with a web splicing unit, a so-called splicer head, of the roll exchanger. The web splicing unit, which is present in a roll exchanger, has the required function for said step $c_1$). Because the web splicing unit is not in operation in order to bind a new material web to a material web which is unwinding at the moment a new roll is prepared, the web splicing unit can be used to prepare the new stock roll.

In a further advantageous embodiment of the method according to the invention, the surplus roll is removed from the stock-roll holder after the stock-roll holder has been moved to a preparation position in the roll exchanger, and then a new stocks roll for preparation is placed in the stock-roll holder and, after the steps a)–c) have been carried out, is moved to an unwinding position in the roll exchanger.

If the material web on the stock roll is spliced to a material web which is unwinding by means of an adhesive, an adhesive is also applied advantageously near the newly formed start of the material web, for example with a glue member of the web splicing unit. Application of the adhesive may take place either before or after the material web is cut through if the material web of the stock roll is secured with the aid of the web splicing unit. In the case of paper, this may, for example, be the application of a layer of glue. In the case of materials which can be heatwelded together such as, for example, certain plastics, this step is redundant.

When applying the method according to the invention in a roll exchanger of the flying type, the new start of the material web is preferably temporarily attached to the stock roll. This prevents the start of the material web flapping while the stock roll is brought at speed into the unwinding position before this material web is bonded to a material web which is unwinding.

The material web, for example the unwound portion thereof, is advantageously inspected during step c). So long as damage is detected, the material web is unwound. In this manner, a minimal stream of waste is created because only that portion of the material web which is damaged is removed. As a precaution, one extra turn, after no further damage has been observed, of the material web of the stock roll may advantageously be wound on the surplus roll. This extra turn can obviously also be inspected.

The invention further relates to a roll exchanger comprising a frame in which at least one stock-roll holder with drive unit is mounted, together with web-takeup means for taking up the start of a material web from the stock roll and unwinding a portion thereof, which web-takeup means comprise a frame in which an interchangeable cylindrical winding-up body has been mounted rotatably about a horizontal shaft, and drive means for rotating the winding-up body, a web splicing unit, means for splicing the winding-up body of the web-takeup means to the material web and movement means for moving the stock roll and the web-takeup means with respect to each other.

Such a roll exchanger of the flying type is also known from EP-A-0547500. This roll exchanger has the drawbacks mentioned previously with respect to the method for preparing the start of a material web according to the prior art.

The roll exchanger of the above-described type is characterized in that the winding-up body is a surplus roll of a stock roll to be incorporated in the frame of the web-takeup means, which surplus roll is removed from the stock-roll holder during operation after rolls have been exchanged in the roll exchanger by the web-takeup means.

In the roll exchanger according to the invention, a new stock roll can automatically be prepared in the roll exchanger, the waste being collected on the surplus roll, as a result of which the waste is collected centrally, and the risk of damage during preparation of the roll is reduced, thus enhancing reliability.

The movement means for moving the web-takeup means and the stock roll with respect to each other may comprise first movement means for placing a stock roll in a preparation position in the roll exchanger and, advantageously, also second movement means for moving the stock roll from the preparation position to an unwinding position in the roll exchanger. Such movement means permit the vertical transportation of a delivered new stock roll to the preparation position and, after preparation, transportation from the preparation position to the unwinding position.

In a further preferred embodiment of the roll exchanger according to the invention, the first and second movement means comprise lifting arms of the stock-roll holder which are hinged about a horizontal shaft in the frame. This embodiment of the movement means makes it possible to take up the non-prepared stock roll directly in the roll exchanger so that separate transportation in the longitudinal direction of the roll exchanger is avoided. As a result of this the risk of damage to the material web of the prepared stock roll is further reduced and reliability further increased.

In a preferred embodiment, each lifting arm comprises a first hinge arm hinged about a horizontal shaft in the frame and a second hinge arm hinged about a shaft located close to the end of the first hinge arm and drive members interacting with the hinge arms. By means of this construction of each lifting arm, an extra degree of freedom is introduced into each lifting arm. This makes it possible to move the stock roll, which is incorporated, with suitable means, for example expanding mandrels, at the end of the second hinge arm, vertically in the roll exchanger in the plane of the preparation position, in which position the stock roll is able to rotate, and also to move it in the longitudinal direction of the roll exchanger from the preparation position to an unwinding position. Moreover, this lifting-arm construction makes it possible for the preparation position for the two stock-roll holders to be a common position which lies between the two stock-roll holders. This has the advantage that only one web-takeup mechanism has to be present in the roll exchanger.

The frame of the web-takeup means is preferably movable so that an accurate positioning of the web-takeup means with respect to the stock-roll holder, both for taking up the surplus roll and preparing a new stock roll, is possible.

In a further embodiment of the roll exchanger, the frame of the web-takeup means is provided with roll-takeup means for taking up the surplus roll from the stock-roll 35 holder, which roll-takeup means can be moved with respect to the frame of the web-takeup means. These roll-takeup means, for example gripping or clamping arms, take up the surplus roll from the stock-roll holder and bring it into the position for splicing and winding up a new start of a a new stock roll.

Depending on the method in which a splice between the material web of the stock roll and the material web which is unwinding is carried out in the roll exchanger, 5 the roll exchanger also may comprise means for applying an adhesive to the new start of the material web of the Stock roll. Further advantageous characteristics of the roll exchanger according to the invention become apparent from the claims. Specifically, the means for applying an adhesive may be a glue member of the splicing unit(9,10). Detection means may be provided for determining the diameter of the stock roll. Inspection means may be provided for inspecting the material web. A transportation system may be provided for moving a new stock roll into the roll exchange. An automatically controlled waste container may be provided for receiving a surplus roll (20) from the web takeup means (11).

The invention also relates to a web-takeup device for application in a roll exchanger, characterized in that the web-takeup device comprises a frame in which a surplus roll is or can be mounted so that it can rotate about a horizontal shaft, and drive means for rotating the surplus roll.

With this construction of the web-takeup means, it is possible easily to remove the damaged material from the stock roll, the waste material being wound on a surplus roll and disposed of centrally.

BRIEF DESCRIPTION OF THE DRAWINGS

The invention will now be illustrated on the basis of the appended drawing, in which.

DETAILED DESCRIPTION

Figure 1:
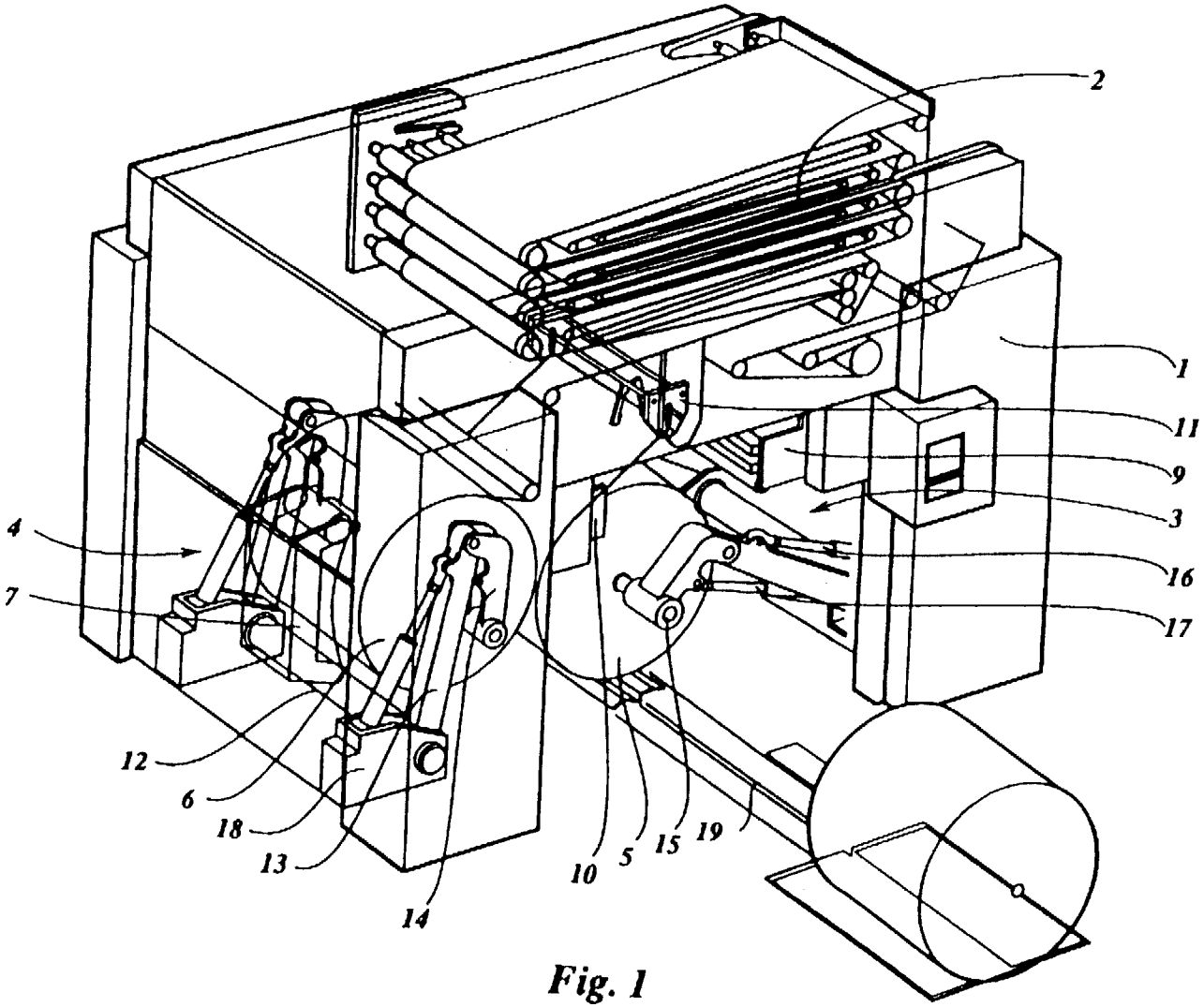
FIG. 1 is a diagrammatic perspective view of an embodiment of a roll exchanger according to the invention.

FIG. 1 is a diagrammatic illustration of a roll exchanger according to the invention, of the stationary 30 splicing type (zero-speed roll exchanger). This roll exchanger comprises a frame, generally indicated by 1, in which, inter alia, a web accumulator 2 and two stock-roll holders 3, 4 are mounted, stock rolls 5, 6 being located in the latter, respectively. The stock-roll holder 3 is in a 35 preparation position A and the stock-roll holder 4 in an unwinding position B. (See FIGS. 2–5). The roll exchanger further comprises drive means 7 (illustrated only for stock-roll holder 4) for driving the stock rolls 5, 6 in the stock-roll holders 3, 4. These drive means 7 are, in the illustrated embodiment of the roll exchanger, of the type described in Dutch Patent Application 8600336.

Reference numerals 9, 10 indicate splicer heads. A web-takeup mechanism 11 according to the invention is also present in the preparation position A. The preparation position A is, in this embodiment of the roll exchanger, midway between the unwinding positions of the stock-roll holders 3, 4.

In the embodiment illustrated, the stock-roll holders 3, 4 comprise lifting arms which each consist of two hinge arms 13, 14. The first hinge arm 13 is fixed on a hinged horizontal shaft 12 in the frame 1. The second hinge arm 14 is hinge-fastened to the arm 13 about a horizontal shaft in the vicinity of the end of the first hinge arm 13. An expanding mandrel 15 is fitted to the end of each second hinge arm 14, with the result that a stock roll 5, 6 can be incorporated in a rotary manner. The movement of the hinge arms 13, 14 is controlled by first and second piston/cylinder assemblies 16 and 17 respectively. The first hinge arms 13 can slide in the shaft direction to take up a stock roll between expanding mandrels and cannot turn on the horizontal shaft 12, which shaft 12 is incorporated in a rotary manner in block 18 of the frame 1. Movement means, which are not illustrated, can slide the lifting arms in the longitudinal direction of shaft 12. Each first piston/cylinder assembly 16 is fastened via one end in the block 18 and via the other end joined to a first hinge arm 13 in order to be able to move the first hinge arm 13. Each second piston/cylinder assembly 17 is joined to a first 13 and a second 14 hinge arm in order to be able to move the second hinge arm 14 with respect to the first hinge arms 13. Instead of piston/cylinder assemblies, other suitable drive members such as cables, spindle constructions and the like may, of course, be used.

A stock-roll holder described above with lifting arms which each comprise hinge arms 13, 14 which are joined together may also be fitted in existing roll exchangers or new roll exchangers without automatic preparation, because this construction provides an extra degree of freedom of movement and hence the possibilities of movement are increased.

FIG. 1 also illustrates a transportation system, generally indicated by 19, for supplying the new stock roll 5. This transportation system 19 may also be used to move an automatically controlled waste container in and out of the roll exchanger.

The method for preparing the start of the material web of a stock roll according to the invention will now be described on the basis of FIGS. 2 to 5, in which similar components are indicated by means of similar reference numerals.

Figure 2:
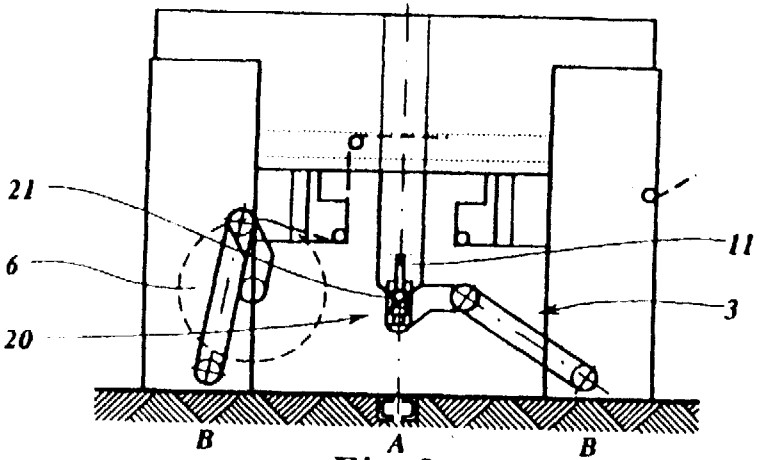
FIGS. 2–5 are diagrammatic views of an embodiment of a roll exchanger according to the invention during the various steps of the method.
Figure 3:
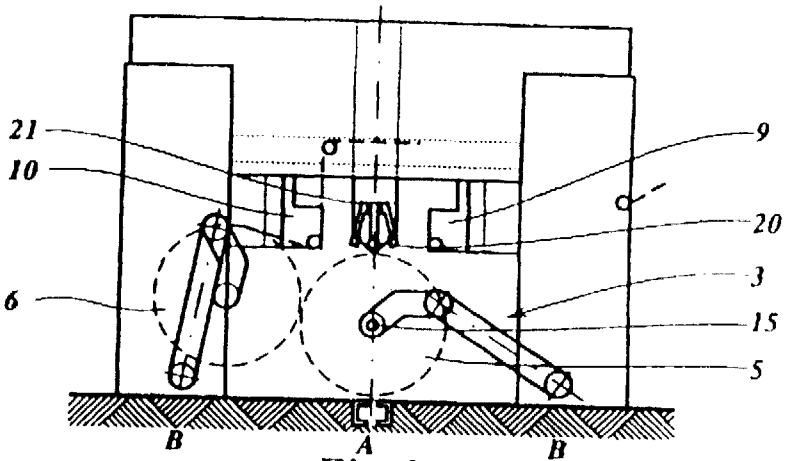
Figure 4:
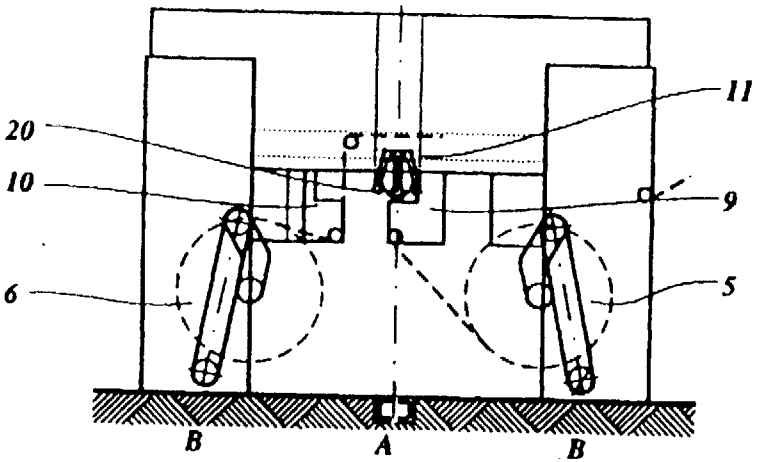

While a material web is unwound from the stock roll 6, the stock-roll holder 3 with a surplus roll 20 therein, i.e. the remaining portion of an unwound roll which is formed after the material web originating from this roll has been cut through, is moved in FIG. 2 from the unwinding position B to the preparation position A. In the preparation position A, the surplus roll 20 is removed from the stock-roll holder 3 and taken up by the web-takeup means 11. The surplus roll 20 is then lifted out of the lifting arms with the aid of gripping arms 21 and taken up between expanding mandrels of the web-takeup means 11, one of said expanding mandrels being joined to a drive unit for rotating the surplus roll 20. The web-takeup means 11 with the taken-up surplus roll 20 are then moved vertically upwards.

The stock-roll holder 3 is then returned to the unwinding position B. A new stock roll 5, its packing material removed, is brought into the preparation position A. The "loose" start of the web is, if desired, fastened to the roll with a temporary adhesive, for example a sticker. If desired a number of data may be recorded on said sticker, for example by means of a bar code applied to the sticker, which, for example, contains information relating to the unwinding direction of the stock roll. These data may be read using suitable means and supplied to a unit for controlling the roll exchanger.

The stock-roll holder 3 is now moved back to the preparation position A and the new stock roll 5 is taken up by the expanding mandrels of the lifting arms of the stock-roll holder 3 and raised vertically so that the new stock roll 5 can rotate. (See FIG. 3).

The web-takeup means 11 with surplus roll 20 are then moved vertically downwards until the surplus roll 20 comes into contact with the new stock roll 5 (step a). The surplus roll 20 is rotated by the drive means of the web-takeup means 11 and the stock roll 5 is also rotated with the aid of driven expanding mandrels 15. Means (not shown) for determining the start of the material web on the stock roll 5 detect the start of the material web. At that moment, a strip of adhesive is applied to the surplus roll 20 or in the vicinity of the start of the material web on the stock roll 5 using means for applying an adhesive which are also a component of the web-takeup means 11. When the stock roll 5 is rotated further, the start of the material web of the stock roll 5 adheres to the surplus roll 20 (step b). On the other hand, the application of an adhesive to the surplus roll 20 may be carried out using a glue member of the web splicing unit 9, 10 before the surplus roll 20 is brought into contact with the stock roll 5.

It is not absolutely necessary to detect the start of the material web of the stock roll 5 and then to take up this start using the web-takeup means 11. It is also possible to take up the outermost turn of the material web of the stock roll at a random position, using the web-takeup means 11.

The web-takeup means 11 are then moved vertically upwards so that a portion of the material web of the stock roll 5 is unwound (step c). When the surplus roll 20 is rotated further, a length of the material web is wound on the surplus roll 20. The condition of the material web between the stock roll 5 and the web-takeup means 11 can be inspected using suitable inspection means (not further described) during this phase of the preparation.

As soon as no further damage is detected on the material web, one further extra turn of the stock roll 5 is wound on the surplus roll 20, after which the stock roll is transported to the unwinding position B. (See FIG. 4). The web splicing unit 9 is then brought into contact with the material web between the stock roll 5 and the web-takeup means 11. The web splicing unit 9 grips the material web and retains this, for example with the aid of a vacuum (step $c_1$). The material web is then cut off between the web-takeup means 11 and the web splicing unit 9, using the web splicing unit 9 (step d). A strip of adhesive is then applied to the new start of the material web with the aid of suitable means.

Figure 5:
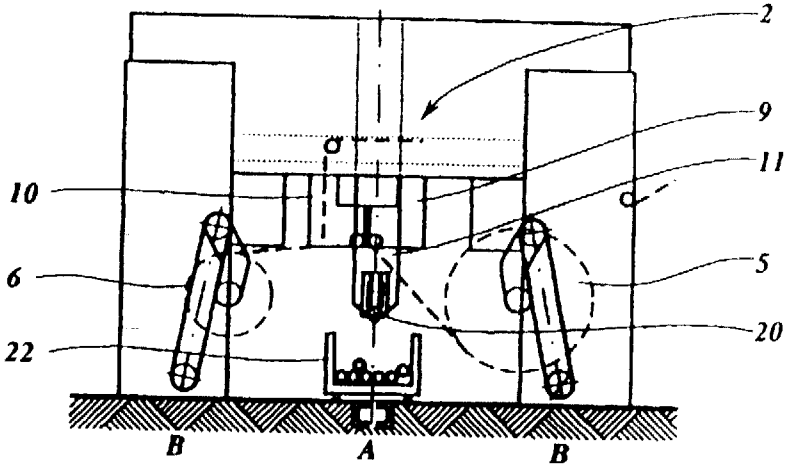

In FIG. 5, the web-takeup means 11 have been moved to a position under the splicer heads 9 and 10 and under the unwinding material web of the stock roll 6 so that there is space to form a splice between the material web of the stock roll 5 and the unwinding material web of the stock roll 6. The splicer head 10 now moves to the preparation position A so that, at the desired moment after the stock roll 6 has been brought to a standstill, the splice between the two material webs can be established. While this splice is being made, the material web present in the web accumulator 2 is (partially) used.

The surplus roll 20 with waste material cut off from the stock roll 5 is then removed from the web-takeup means 11. This removal of the surplus roll 20 from the web-takeup means 11 may, for example, be carried out by bringing an automatically controlled waste container 22 to the preparation position A under the web-takeup means and depositing the surplus roll 20 therein. The automatically controlled waste container 22 then leaves the roll exchanger once again.

After the splice between the two material webs has been made, the cycle is repeated.

The sequence of the various steps described above, as well as the location where these steps are carried out, can be altered. Cutting-off of the material web may, for example, also take place after an adhesive has been applied to the new start of the material web.

The entire duration of the preparation in the roll exchanger is chosen such that, if a stock roll is rejected for one reason or another, there is sufficient time to take up and prepare another stock roll in the roll exchanger. In that case, the same surplus roll is used twice as winding-up body.

Detection means for determining the diameter of the stock roll may be present in the preparation position A in the roll exchanger. These means measure (for example, using ultrasonic waves) the diameter of the stock roll and, via a control mechanism, the expanding mandrels of the lifting arms can be directed immediately to the correct position to take up the stock roll.

The invention is not restricted to a roll exchanger of the stationary splicing type, but may be applied in any type of roll exchanger.

In a roll exchanger of the flying type, the preparation position will usually be in the vicinity of one end of the device. In the roll exchanger of the flying type disclosed in NL-A-8702407, a new stock roll is taken up in the roll exchanger on the front and the surplus roll removed from the device. The preparation position is at the front in this roll exchanger. The preparation of a stock roll will take place essentially in the same manner as described above in the case of a zero-speed roll exchanger. The new end of the material web will, however, not be retained by means of a web splicing unit but, with the aid of an easily breakable joint, be secured to the stock roll in order to prevent said new start flapping when the stock roll is supplied at speed.

We claim:

1. Method for preparing the start of a material web of a stock roll (5) in a roll exchanger, which method comprises the steps of:

a) bringing a cylindrical winding-up body of web-takeup means (11) for taking up a web into contact with the material web of a stock roll (5), b) taking up the material web from the stock roll (5) on the winding-up body, c) winding up a length of the material web of the stock roll (5) on the winding-up body, and d) breaking the material web between the portion of the material web wound on the winding-up body and the stock roll (5), creating a new start of the material web of the stock roll (5), which method is characterized in that, prior to step a), a surplus roll (20) of a stock roll is removed from a stock-roll holder (3) and is incorporated in the frame of the web-takeup means (11) as a cylindrical winding-up body for carrying out the subsequent steps a)–d) and an adhesive is applied to at least one of the material webs of the stock roll and/or the surplus roll.

2. Method according to claim 1, characterized in that a step $c_1$) of fastening the material web to a gripping point between the stock roll (5) and the surplus roll (20) is carried cut after step c) and in step d) the material web is cut off between the gripping point and the surplus roll (20).

3. Method according to claim 2, characterized in that step $c_1$and d) are carried out using a web splicing unit (9, 10) of the roll exchanger.

4. Method according to one of the preceding claims, characterized in that the surplus roll (20) is removed from the stock-roll holder (3) after the stock-roll holder (3) has been moved to a preparation position in the roll exchanger, and then a new stock roll (5) for preparation is placed in the stock-roll holder (3) and, after the steps a)–c) have been carried out, is moved to an unwinding position in the roll exchanger.

5. Method according to claim 1, characterized in that an adhesive is applied near the new start of the material web.

6. Method according to claim 1, characterized in that the new start of the material web is temporarily attached to the stock roll (5).

7. Method according to claim 1, characterized in that the unwound portion of the material web is inspected during step c).

8. Roll exchanger comprising a frame (1) in which at least one stock-roll holder (3, 4) with drive unit (8) is mounted, together with web-takeup means (11) for taking up the start of a material web from the stock roll (5) and unwinding a portion thereof, which web-takeup means (11) comprise a frame in which an interchangeable cylindrical winding-up body has been mounted rotatably about a horizontal shaft, and drive means for rotating the winding-up body a web splicing unit (9,10) means for splicing the winding-up body of the web-takeup means to the material web and movement means for moving the stock roll and the web-takeup means (11) with respect each other, wherein the roll exchanger includes means for using a surplus roll (20) of stock roll at the winding-up body to be incorporated in the frame of the web-takeup means (11), and further including means for removing the surplus roll from the stock-roll holder (3) during operation after rolls have been exchanged in they roll exchanger by the web-takeup means(11).

9. Roll exchanger according to claim 8, characterized in that the movement means for moving the web-takeup means (11) and the stock roll with respect to each other comprise first movement means for placing a stock roll (5) in a preparation position in the roll exchanger.

10. Roll exchanger according to claim 9, characterized in that the movement means also comprise second movement means for moving the stock roll (5) from the preparation position to an unwinding position in the roll exchanger.

11. Roll exchanger according to claim 10, characterized in that the first and second movement means comprise lifting arms of the stock-roll holder (3, 4) which are hinged about a horizontal shaft (12) in the frame (1).

12. Roll exchanger according to claim 11, characterized in that each lifting arm comprises a first hinge arm (13) hinged about a horizontal shaft (12) in the frame (1) and a second hinge arm (14) hinged about a shaft located close to the end of the first hinge arm (13) and drive members (16, 17) interacting with the hinge arms (13, 14).

13. Roll exchanger according to one of claim 8, characterized in that the frame of the web-takeup means (11) is movable.

14. Roll exchanger according to one of claim 8, characterized in that the frame of the web-takeup means (11) is provided with roll-takeup means (21) for taking up the surplus roll (20) from the stock-roll holder (3), which roll-takeup means (21) can be moved with respect to the frame of the web-takeup means (11).

15. Roll exchanger according to one of claim 8, characterized in that the roll exchanger also comprises means for applying an adhesive to the new start of the material web of the stock roll (5).

16. Roll exchanger according to claim 15, characterized in that the means for applying an adhesive are a glue member of the web splicing unit (9, 10).

17. Roll exchanger according to one of claim 8, characterized in that detection means are present for determining the diameter of the stock roll (5).

18. Roll exchanger according to one of claim 8, characterized in that inspection means are present for inspecting the material web.

19. Roll exchanger according to one of claim 8, characterized in that the roll exchanger is provided with a transportation system (19) for moving a new stock roll (5) into the roll exchanger.

20. Roll exchanger according to one of claims 8, characterized in that the roll exchanger is provided with an automatically controlled waste container which is suitable for receiving a surplus roll (20) from the web-takeup means (11).

* * * * *